US005881811A

United States Patent [19]

Lessi et al.

[11] Patent Number: 5,881,811

[45] Date of Patent: Mar. 16, 1999

[54] MODELING OF INTERACTIONS BETWEEN WELLS BASED ON PRODUCED WATERCUT

[75] Inventors: Jacques Lessi, Maule; Didier Pavone, Ecully, both of France

[73] Assignee: Institut Francais du Petrole, Rueil-Malmaison, France

[21] Appl. No.: 769,804

[22] Filed: Dec. 20, 1996

[30] Foreign Application Priority Data

Dec. 22, 1995 [FR] France ..... 95 15338

[51] Int. Cl.[6] ..... E21B 43/14

[52] U.S. Cl. ..... 166/245; 166/252.2; 166/264; 166/369

[58] Field of Search ..... 166/244.1, 245, 166/250.01, 252.1, 252.2, 264, 267, 369

[56] References Cited

PUBLICATIONS

SPE (Society of Petroleum Engineers) California Regional Meeting, Mar. 23–25 1988, Long Beahc, Calif., XP000602340, pp. 307–323, by V. Sankur et al, entitled "A Simplified Modeling Study of Vickers East Waterflood Project in Inglewood Field".

Craig, F.F. Jr., The Reservoir Engineering Aspects fo Waterflooding, Soc. Petroleum Engrs, Monograph vol. 3, Chapter 8, pp. 78–96 (1971).

*Primary Examiner*—Roger Schoeppel

*Attorney, Agent, or Firm*—Antonelli, Terry, Stout & Kraus, LLP

[57] ABSTRACT

The invention is a method for modeling the effects of interactions between wells on the watercuts in effluents produced by one or more wells through a zone of an underground hydrocarbon reservoir under development, swept by a fluid under pressure injected through one or more injection wells or swept by water from an aquiferous zone, in order to optimize the reservoir production. The method includes selecting a set of significant data from measurements taken from sweep fluid injection records and from records relative to the effluents produced by a series of wells of the zone, and setting up, by means of iterations, an optimized linear model connecting the variations with time of these watercuts with the variations with time of the significant data. The invention is useful to optimize the petroleum production of a reservoir.

14 Claims, 8 Drawing Sheets

MODELING OF INTERACTIONS BETWEEN WELLS BASED ON PRODUCED WATERCUT

BACKGROUND OF THE INVENTION

1. Field of the Invention

The present invention relates to a method for modeling the effects of interactions between wells on the watercut in effluents produced by an underground hydrocarbon reservoir under development, swept by a fluid under pressure, in order to optimize the reservoir production.

2. Description of the Prior Art

The production of water is a major problem in petroleum production. Operators can be confronted with situations where the watercut in the production of a well is very high whereas the in-place oil recovery ratio remains low, which clearly shows the ineffectiveness of a sweeping operation. They can be led to cease producing from the well concerned, with all the economic consequences entailed through lack of solutions allowing these water inflows to be controlled. It is within the scope of the production of stratified reservoirs swept by water, for example, that complex evolutions of this watercut can sometimes be observed.

It is well-known to treat locally a well where water inflows occur, by plugging the well zones producing water by injecting cement, polymers, gels, etc, and using packers in order to delimit the zones to be treated while the products are set. This technique is difficult to implement because the critical zones first have to be properly defined. Servicing operations are heavy and expensive, with no economic justification for wells that are often at the limit of profitability.

In order to contain great water inflows, it is also well-known to subject the reservoir to global treatments, for example by injecting polymers therein, the rate of success thereof remaining low and notably difficult to predict.

Reservoirs generally have very complex physics. Consider the case of a well crossing a certain number i of reservoir levels considered to be hydraulically independent in proportion to the environment of the well (i=2 in the case of FIG. 1). Under the effect of a draw-off with, for example, a flow rate Q imposed by a pump, the bottomhole pressure is expressed by the relations as follows:

$$Q = \sum_i Qi = \sum_i \alpha_i Q \text{ with } \sum_i \alpha_i = 1$$

$$Qi = IP_i(P_i - Pwf)$$

$$f_w = \sum_i \alpha_i f_{wi}$$

where Pi is the pressure prevailing in bed i. The overall flow rate Q of the well is made up of the sum of the contributions Qi of all the beds i, each contribution depending on the productivity index $IP_i$ of the bed considered and on the pressure difference $P_1-P_{wf}$ applied. The watercut fw of the well results from an average of the watercuts fwi of each bed, weighted by the contribution thereof to the overall flow rate of the well.

The expression Qi=IPi (Pi−Pwf) shows that any variation ÆPi of the pressure Pi of a bed leads to a variation ÆQi of the flow rate Qi of the bed and, if the watercuts of the beds are different, to a variation of the watercut of the well according to the changes in the relative contributions of each bed to the overall production of the well. The variation ÆPi of the pressure of a bed can notably be due to a variation of the injection or production rates of the neighbouring wells. Besides, when the pressures in the various beds are substantially different, a variation of the production pressure P leads to a distribution variation of the flow rates (αi).

Furthermore, in cases where the pressures Pi of the various beds are substantially different, any change in the stress imposed on the well: flow rate Q of the pump or pressure $P_{wf}$ in the well, will lead to a variation of the watercut, an increase or a decrease according to the relative distributions of the saturations and of the pressures of each bed.

SUMMARY OF THE INVENTION

Although reservoirs have very complex physics and the pressures are often variables that remain undiscovered through lack of sufficient measurements, the method according to the invention nevertheless allows to modeling, in a series of wells crossing a zone of an underground hydrocarbon reservoir under development and swept by a fluid under pressure (an injected fluid or a fluid from a neighbouring aquiferous zone), the effects of interactions between wells on the watercut in the effluents produced by at least one producing well of this series of wells, in order to optimize the production of the reservoir.

The method comprises:

selecting a set of significant data from raw data taken from records relative to the injection of sweep fluids in the reservoir and from records relative to the production of effluents by one or more production wells, and setting up, by iterations, an optimized linear model connecting the variations with time of the significant data relative to the watercut in the production of the producing well with the variations with time of the significant data relative to the other wells of the series of wells.

When the interaction factors affecting the production of water being brought out by the model thus achieved, reservoir engineers are in a position to influence various parameters: selection of the injection wells, injection rates, production rates, etc, in order to increase the sweep efficiency and the oil recovery rate.

According to an implementation method, selection of the significant data comprises frequency filtering of the variations of the raw data relative for example to the watercut of this producing well on the one hand and to other wells of the series of wells on the other.

According to an embodiment, selection of significant data comprises for example detecting fluctuations at a low frequency, much lower than the frequency range with which the raw data relative to the watercut are measured.

According to an embodiment, collection o f the significant data comprises selecting, from the production and /or injection wells, a limited number of wells exhibiting the greatest interactions with the producing well.

Selection of significant data can comprise, for example, a preliminary statistical processing of the raw data and possibly selecting therefrom a set of data exhibiting a regular spacing in time.

According to an embodiment, the method comprises applying to one or more injection or production wells voluntary stresses modifying the raw input data so as to better select the wells exhibiting interactions.

According to an implementation method suited for modeling the effects of mutual interactions exerted by various wells of a series of wells on watercuts in the effluents respectively produced by various producing wells swept by a fluid under pressure, in order to optimize the production of the reservoir, a global optimization of the various models obtained is preferably also achieved by taking account of the crossed interactions between the significant data appearing effectively in each of them, so as to maximize the overall production of the zone.

A fine predictive model of the behaviour of wells, resulting from the method according to the invention, allows the proper assessing of the effectiveness of the well treatments, better than the current methods carried out from an average behaviour that is more or less representative. Such a model, extended to a series of wells, provides a mechanism for optimizing oil production from a reservoir.

The modeling performed has the effect:

- improving the image of the reservoir, since the qualitative interpretation of the interferences shown allows to clarify the hydraulic communications between wells and the correlations of the reservoir bodies, and
- improving the diagnosis of the sweep condition of the reservoir, since the watercut variations are directly related to the saturation contrasts between the various beds, therefore to the sweep condition thereof. Analysis of the interferences allows better selection of wells to be candidates for water inflow prevention treatments, or even improved treatment operating conditions. Furthermore, information relative to the surface sweep condition of each bed can be obtained from correlations between wells and comparisons of the behaviour of several producing wells.

BRIEF DESCRIPTION OF THE DRAWINGS

Other features and advantages of the method and of the device according to the invention will be clear from reading the description hereafter of embodiments given by way of non limitative examples, with reference to the accompanying drawings in which.

DESCRIPTION OF THE INVENTION

The watercut of a well increases with time even if the rates of injection and of production of the wells remain constant, it is a drift due to the permanent sweeping of the beds by the sweep fluid and to the progressive replacement of oil by water in the reservoir. It is a slow phenomenon that appears from the time of the breakthrough of water in the producing wells and which is spread over several years. It may thus be considered that the watercut of a well is made up of a drift and of fluctuations due to disturbances in neighbouring wells:

$$fw = \text{drift} + \text{Æ}fw(\text{disturbances}).$$

Figure 1:
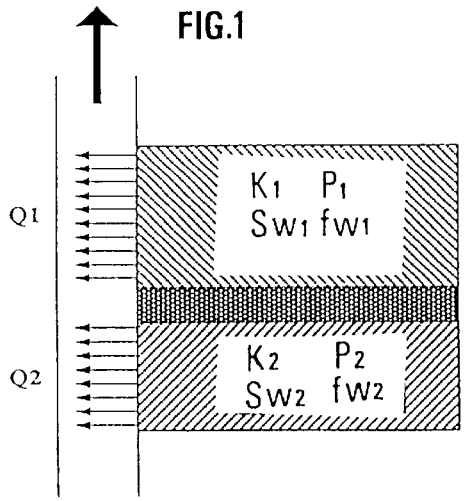
FIG. 1 diagrammatically shows a producing well producing from two reservoir levels considered as hydraulically independent in proportion to the environment of the well.
Figure 2:
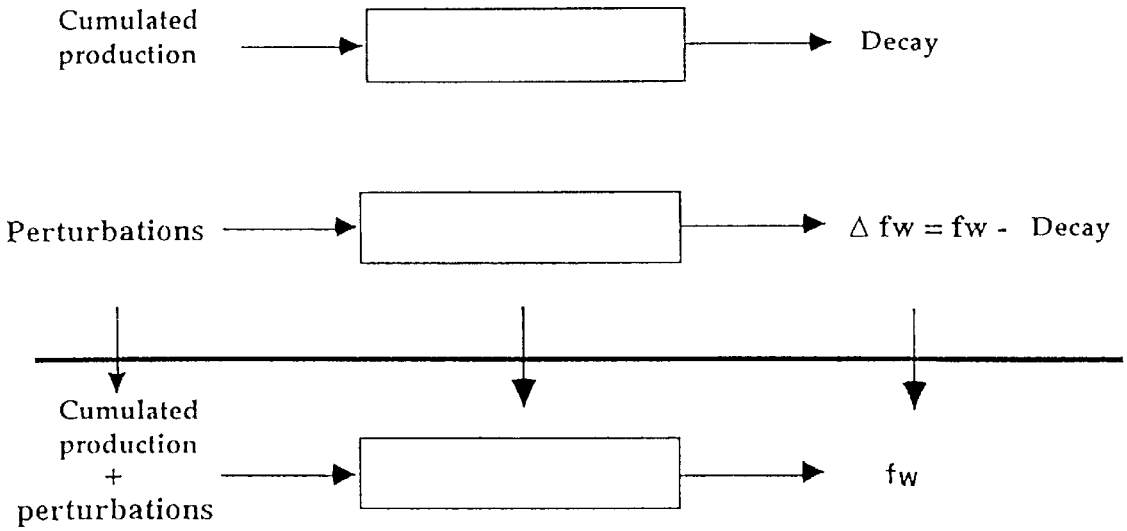
FIG. 2 diagrammatically illustrates the connection between disturbances affecting the injection and/or production rate of neighbouring wells.

Determination of the variations of the watercut fw of a well is then obtained by taking account of the drift due to the cumulated production of fluids in this well and by modeling the connection existing between disturbances due to variations in the rate of injection and/or of production of neighbouring wells, according to the pattern of FIG. 2.

As has been mentioned above, the method according to the invention comprises determining a linear system that connects the variations of the watercut of a well with the injection and production variations of the neighbouring wells. An ARX type auto-regressive model is for example selected from a mathematical software library such as "MATLAB", well-known specialists, which allows to establishing of transfer function that may exist between two signals. This transfer function characterizes the physical system concerned.

Figure 3:
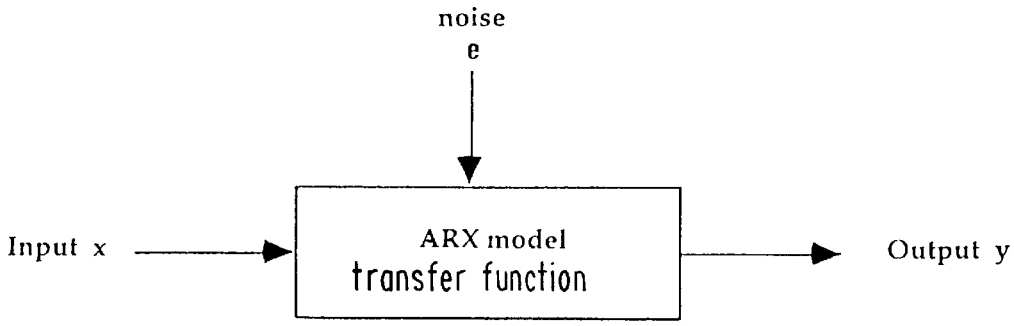
FIG. 3 illustrates the relation mode established by the linear model selected.

The linear model ARX connecting an input signal x with an output signal y as schematized in FIG. 3 is characterized by the equation as follows:

$$A(q)y(t)=B(q)x(t-nk)+e(t)$$

with nk: delay q: delay operator $$A(q)=1+a_1q^{-1}+\ldots+a_{na}q^{-na},\ na \text{ order of } A(q)$$

$$B(q)=b_1+b_2q^{-1}+\ldots+b_{nb}q^{-nb'},\ nb \text{ order of } B(q).$$

More explicitly:

$$y(t)+a_1y(t-1)+\ldots+a_{na}y(t-na)=b_1x(t-nk)+b_2x(t-nk)+b_2x(t-nk-1)+b_{nb}x(t-nk-nb+1)+e(t)$$

If na=0, the model is transverse: the output only depends on the inputs.

If na≠0, the model is recursive: the output depends on the inputs but also on the previous outputs.

A linear model with a single input x has been defined for simplicity reasons. However, it is clear that such a model can be readily generalized to several inputs.

It has been established that the selection of a linear model was perfectly legitimate by calculating therefore the individual variations of the watercut of a well corresponding to n distinct disturbances and by checking that the global watercut variation resulting from the effect of n disturbances present simultaneously was definitely equal to the sum of the calculated individual variations, apart from the drift effects.

Selection of the significant data

In order to model the interactions that exist between injection or production wells W1, W2, . . . , Wn, raw operating data taken from production and injection records are used and significant data are formed therefrom.

Production records are made up of measured data: injected and produced flow rate measurements, watercut measurements, etc, with a more or less regular sampling interval. These measurements are often "noise-infested" and exhibit a great dispersion. It is therefore essential first of all to make them more significant by:

suppressing the deviant measurements due to the effects of noise and by eliminating the parts of higher frequency of the raw measurement variation spectrum, notably by means of statistical methods or of signal processing methods well-known in th is field, and by re-estimating possibly from raw measurements obtained at irregular intervals a data collection with a constant sampling interval.

The wells whose data will be taken into account are also selected from the wells W2, W3, . . . , Wn of the field under development, those which are the most likely to interact with those of a well W1 whose watercut is to be modeled. To that effect, for each pair of wells (W1, W2), . . . , (W1, Wn), the significant data obtained previously and the watercut of well W1 are crosscorrelated, and the wells whose crosscorrelation coefficient is the highest are selected from wells W2, . . . , Wn.

After selecting the significant data of the wells that are the most likely to interact, they are applied as input data to the linear model selected and the particular equation modeling the interactions between the wells selected is determined. By performing then an analysis and an interpretation of the results of the representative model, it is possible to influence the factors likely to decrease the watercut of the wells modeled, and thereby to increase oil production.

The modeling operation described can be repeated in order to model the watercuts in the production of several producing wells of the zone of the reservoir, by connecting them with significant data of other wells of the zone.

Crossed interactions may be observed between the modeled watercuts because the significant production data of one or more producing wells whose respective watercuts have been modeled appear themselves in one or more other models achieved for other producing wells. In this case, a global optimization of the various models obtained is performed by taking account of these crossed interactions, in order to maximize the overall production of the zone.

The validity of the systematic approach selected to define the method of modeling the watercut in the production of a well has been checked from real data from an oil field of a stratified and heterogeneous reservoir swept by injection water. In particular, it has been possible to model adequately the case history of the watercut of a well of this field by means of the selected auto-regressive model ARX comprising as input data the delayed monthly productions or injections of several neighbouring wells.

MODELING EXAMPLE

Modeling of the evolution of the watercut of a well W1

Figure 4:
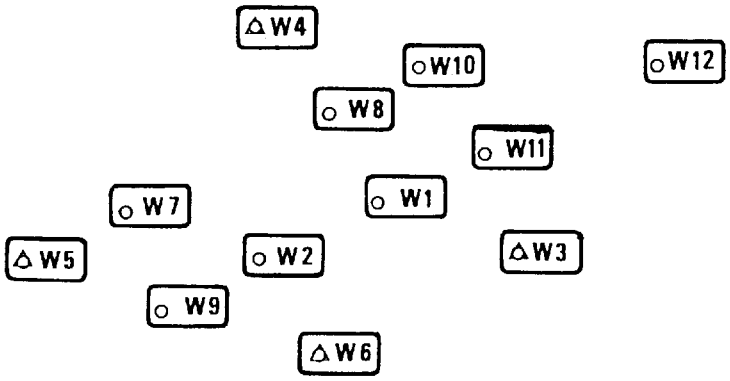
FIG. 4 shows the well pattern of the wells considered W1–W12 in relation to one another, with whose data the method was tested.

A group of 12 wells crossing this reservoir, framed in FIG. 4, injection wells (W4, W5, W6 and W3) and 8 producing wells (W7, W8, W10, W9, W2, W1, W12 and W11), has been considered. The positioning of the various injection and production wells W1, W2, W3, . . . , W12 is relatively regular (FIG. 4). The order of magnitude of the spacing between wells is of the order of 500 meters. The examples hereafter relate to the modeling of the watercut variations of a central producing well W1.

The system to be identified here is as follows: the output data are the watercut of the well W1 considered, the potential input data are the volumes of water injected and of fluid produced by the 10 neighbouring wells W2 to W12.

1—Selection of the significant data a) Output parameters

Watercut raw data measured by means of samplings at the wellhead at very irregular time intervals (from several days to about 1 month) and monthly values obtained by average of raw measurements performed during a calendar month, whatever the number of measurements obtained, are available.

Figure 5:
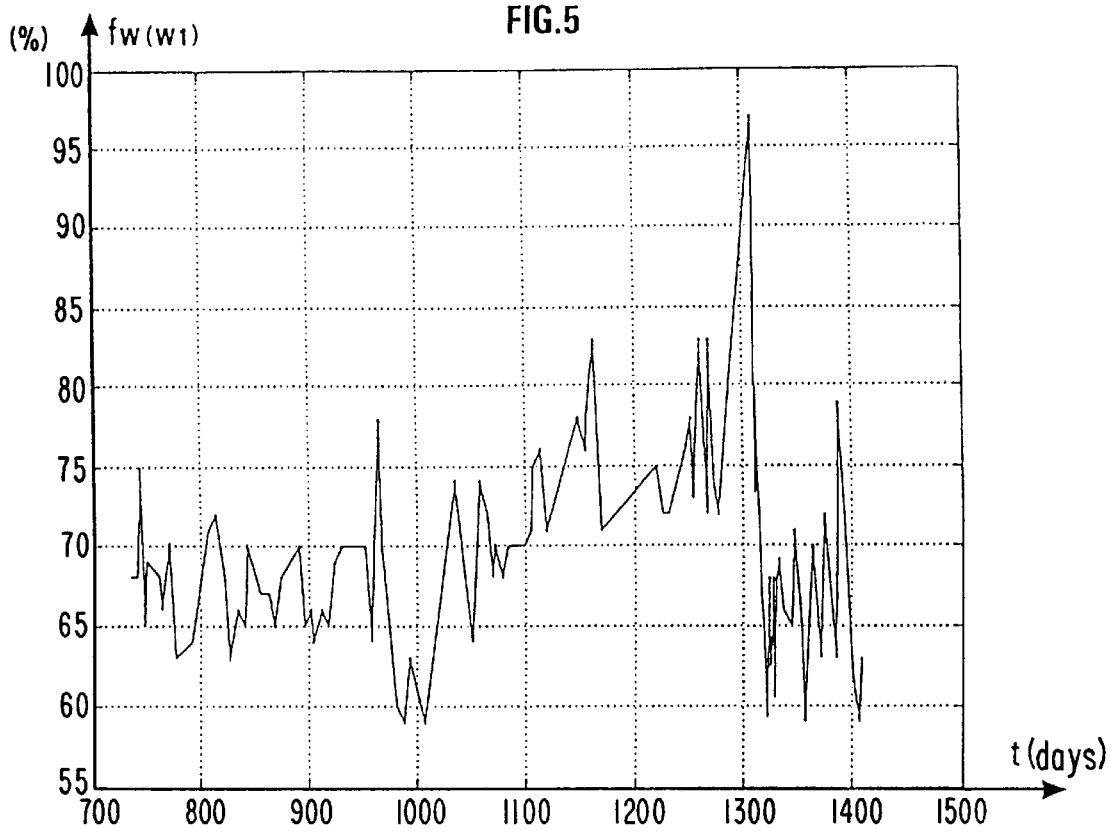
FIG. 5 diagrammatically shows the evolution, as a function of the time t, of the raw measurements fw(W1) of the watercut of well W1.

FIG. 5 shows the evolution of the raw measurements relative to the watercut of well W1 during the time considered as the initial time. Very sudden "high frequency" variations can be observed, characteristic of a dispersion connected with noise or measuring errors, around a slower evolution (at a lower frequency). These variations, that correspond to "significant" variations of the watercut (connected with interferences), have to be established.

Figure 6:
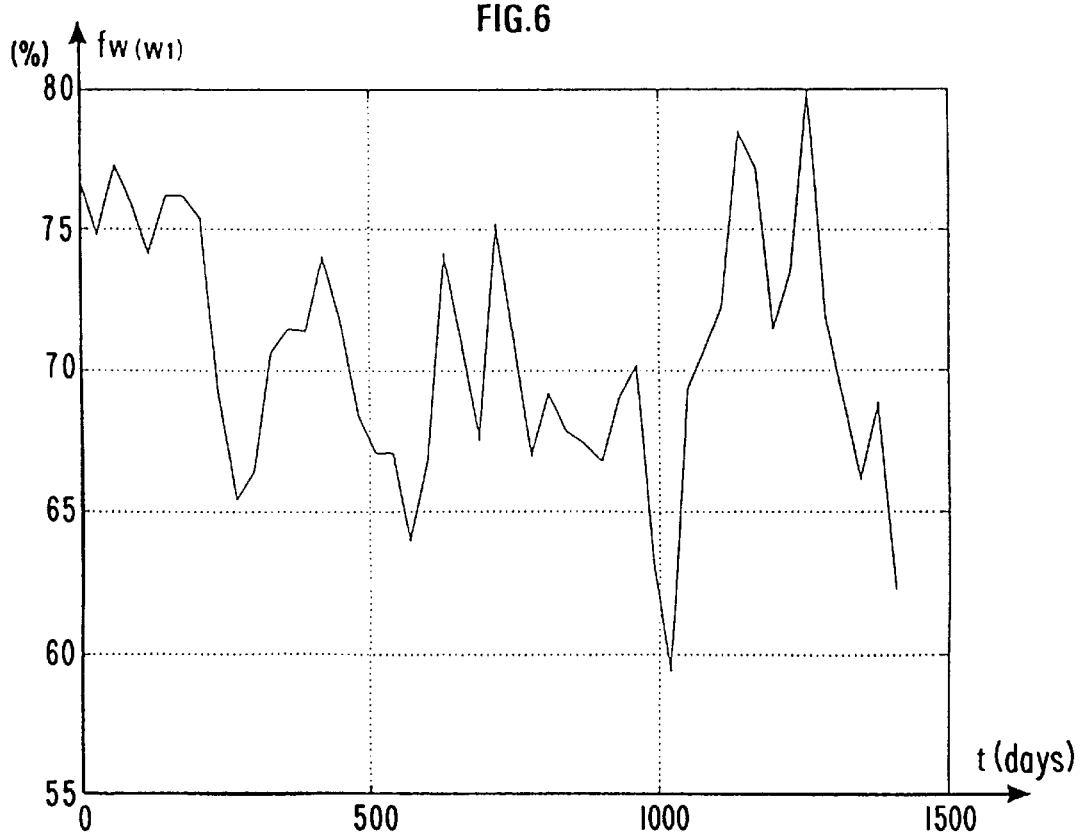
FIG. 6 diagrammatically shows the evolution, as a function of the time t, of the monthly averages of the watercut of well W1.

A solution for filtering the "high frequency" components may for example consist in using the monthly watercut averages available with a relatively low and more regular sampling interval (about 30 days). The mean values are less noise-infested than the raw measurements (see FIG. 6), the averaging process corresponding to a certain filtering of the high frequencies. The slow variations of the watercut are more readily distinguished. Elimination of the highest part of the frequency spectrum of the watercut mean values shown in FIG. 7 allows the significant measurement diagram of FIG. 8 to be obtained.

b) Model input parameters

Figure 9:
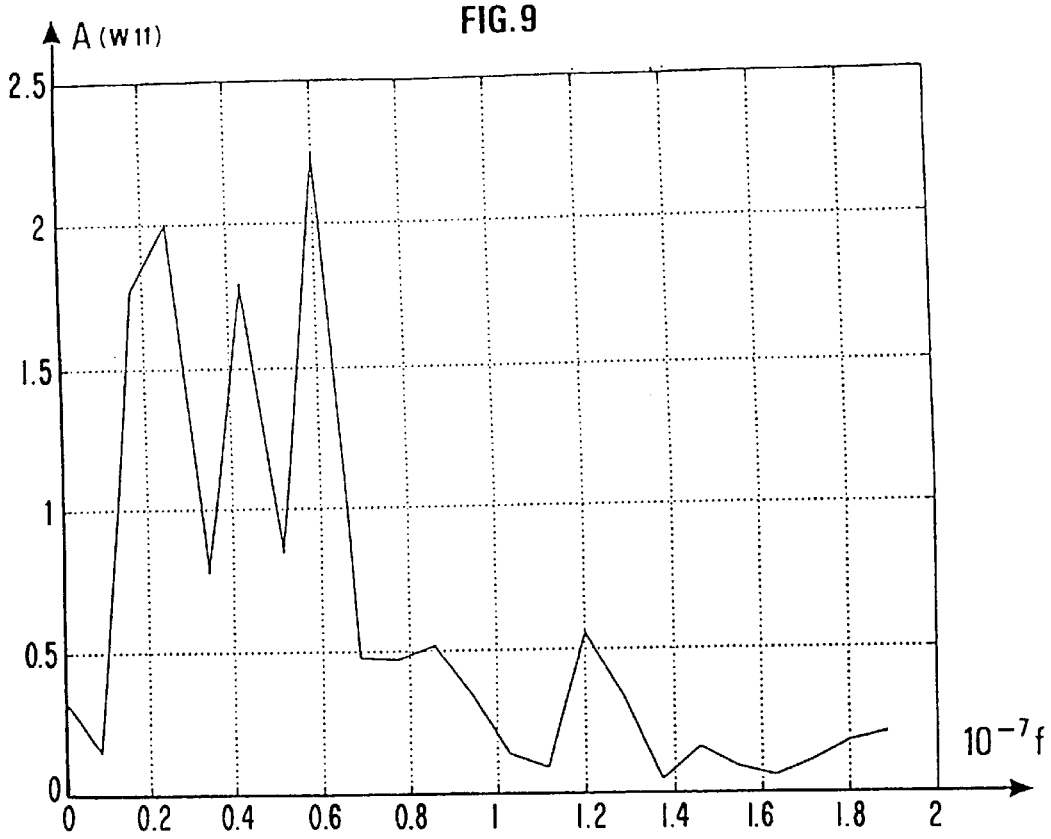
FIG. 9 diagrammatically shows the frequency spectrum A(W11) of the values of the monthly flow rates of producing well W11 used in the model.
Figure 10:
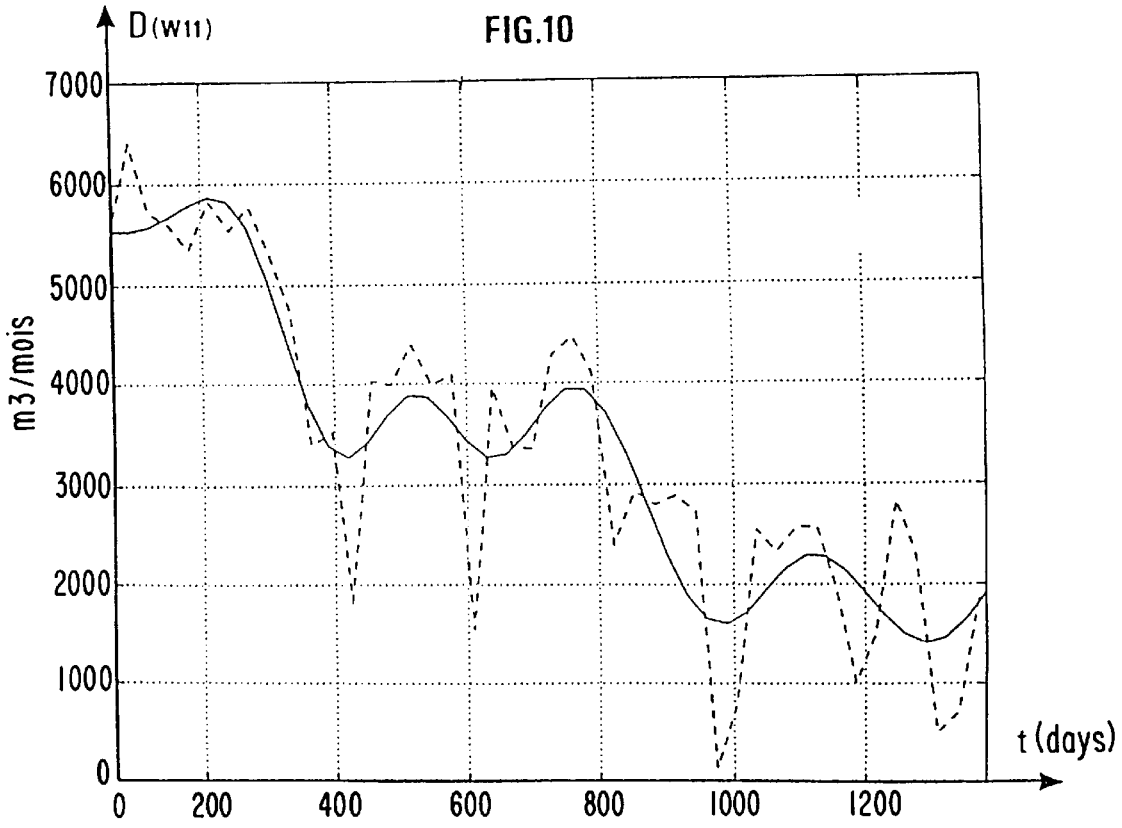
FIG. 10 shows the evolution, as a function of the time t, of the monthly values of the flow rate D(W11) produced by well W11 (curve in dotted line), corrected (curve in full line) after filtering the high frequencies of the spectrum of FIG. 9 (input data)

The injection and production rate data of the 12 wells considered are monthly values expressed in $m^3$/month. FIGS. 9 and 10 for example, show the flow rate evolutions respectively of one of the producing wells W11 and of one of the injection wells W4, with a monthly sampling. Their histograms (not shown) have a Gaussian type distribution form.

2—Measurement processing

Selection of a data collection with a regular spacing

In order to take into account possible spacings between the sampling periods, a collection of values regularly spaced out in time with a relatively fine interval (monthly for example) is evaluated by interpolation.

Data filtering

Figure 7:
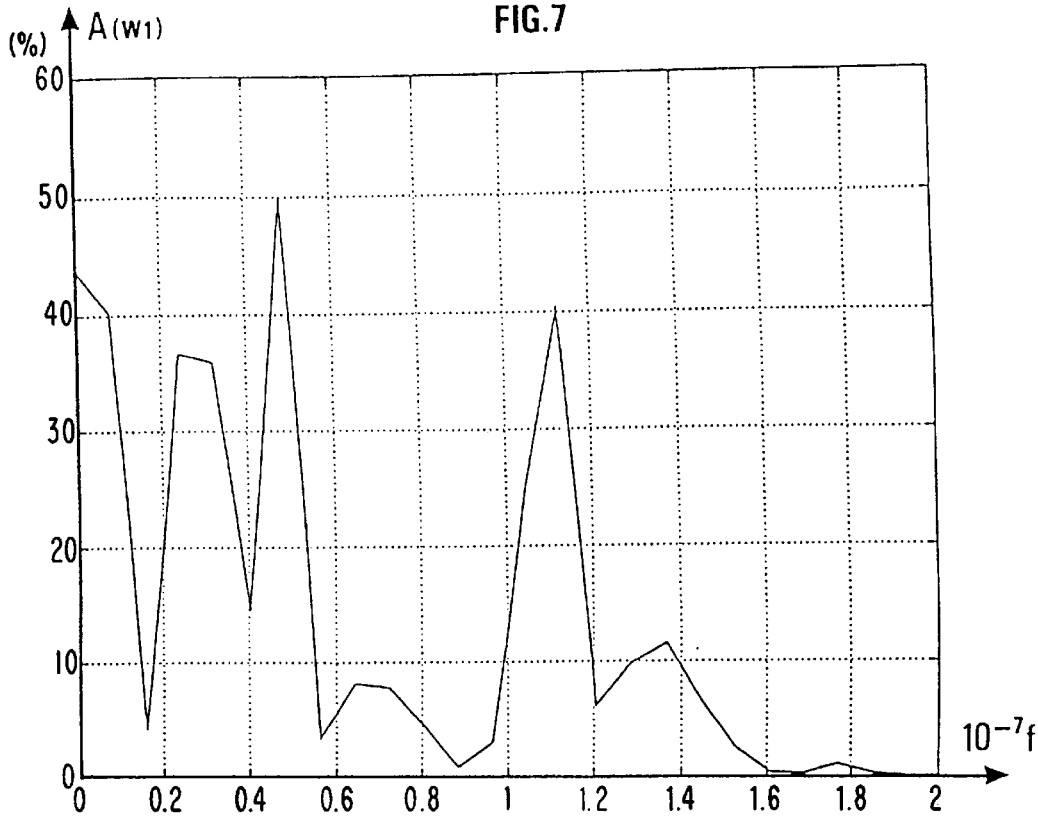
FIG. 7 diagrammatically shows the frequency spectrum A(W1) of the mean values of the watercut of well W1.

Ouput data filtering:

FIG. 7 shows the averaged measurement spectrum of the watercut of well W1 with the low frequencies have a greater spectral energy, which is expressed in the time domain by slow and more significant watercut variations. In order to eliminate the highest low-energy frequencies that can be attributed most probably to noises and measuring errors, a low-pass filtering is applied. The cutoff frequency of the low-pass filter selected is 0.5 $10^{-7}$ Hz, i.e. a cutoff period of 231.48 days (7.7 months). It is however possible to modify the cutoff frequency of the low-pass filter and to keep for example the peak at 1.1 $10^{-7}$ Hz in case it corresponds to a possible interference, and to check if the model that will take it into account is improved or not.

Figure 8:
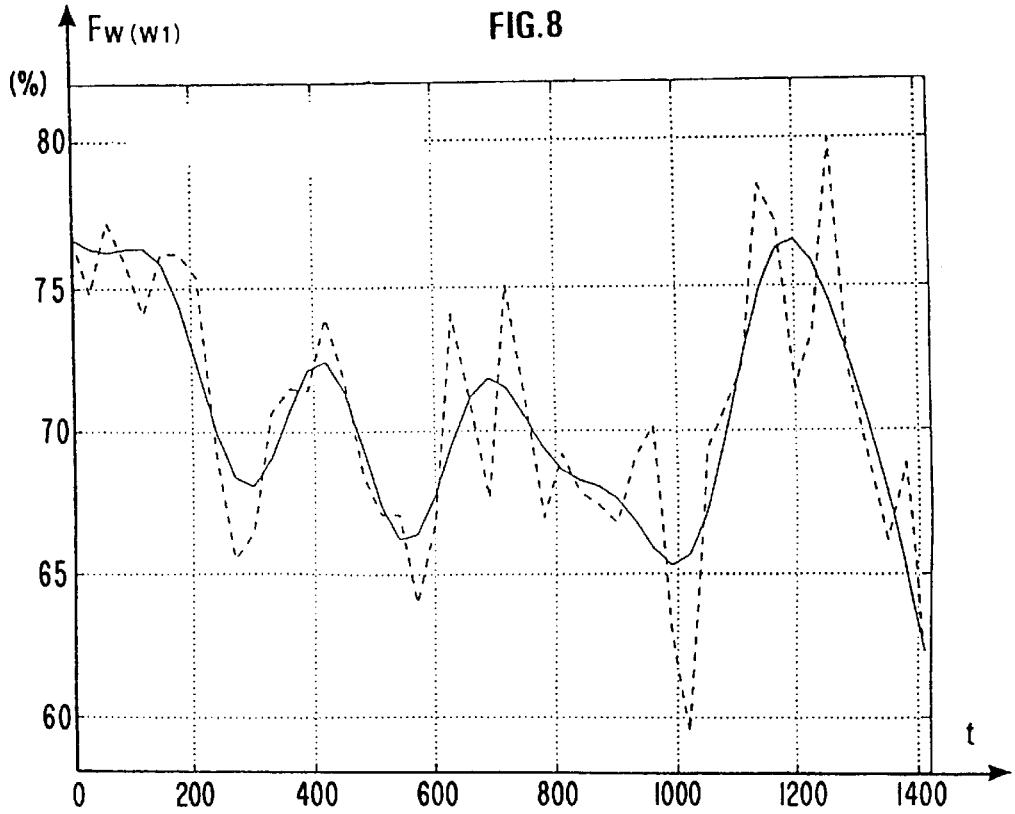
FIG. 8 shows the evolution, as a function of the time t, of the monthly averages fw(W1) of the watercut of well W1 (curve in dotted line), corrected (curve in full line) after filtering the high frequencies of the spectrum of FIG. 7 (output data)

After filtering, the validated variation diagram of the watercut of well W1 is that of FIG. 8.

Figure 11:
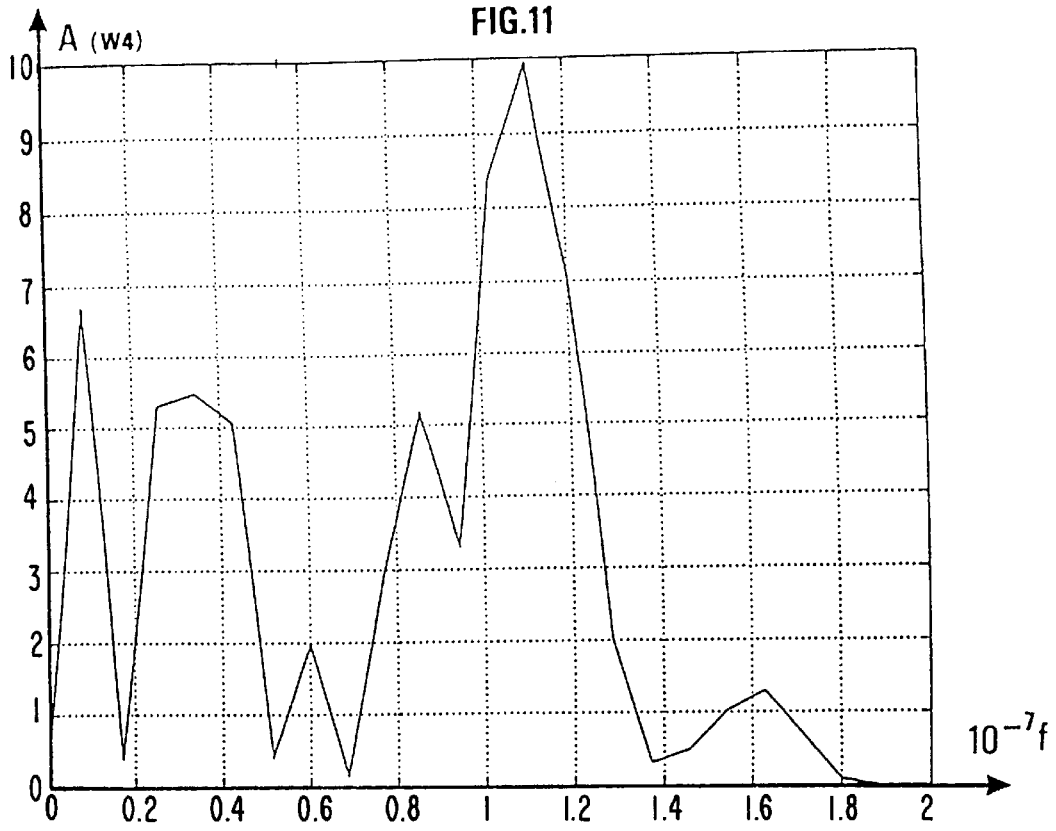
FIG. 11 diagrammatically shows the spectrum of the mean values of the monthly volumes of water injected in injection well W4.
Figure 12:
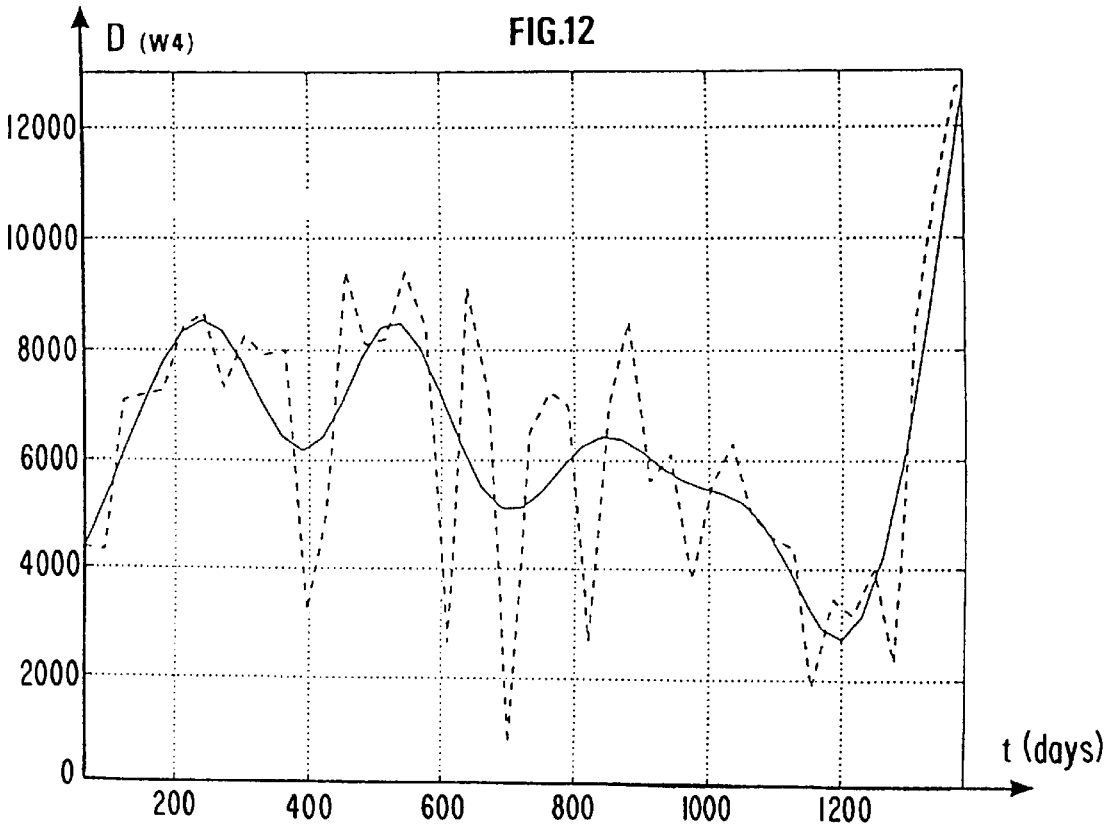
FIG. 12 shows the evolution, as a function of the time t (curve in dotted line), of the monthly averages of the flow rate D(W4) of injection well W4, corrected (curve in full line) after filtering the high frequencies of the spectrum of FIG. 11 (input data)

Input data filtering:

The width of the spectra respectively associated with the raw input data taken respectively at producing well W11 (FIG. 9) and at injection well W4 (FIG. 11) is restricted similarly by applying low-pass filters; which has the effect of smoothing the resulting variation diagrams (FIG. 10 and FIG. 12). The same cutoff frequency as that selected for the output data can for example be chosen.

3—Selection of the most significant input data by cross-correlation

A 12-input system is very complex. The more inputs and consequently model coefficients, the smaller the adjustment deviation of the model from the learning interval, but the model will be too specific to this interval and will therefore not be reliable for time extrapolation. It is consequently preferable to keep only the input data that influence significantly the output behaviour.

Figure 13:
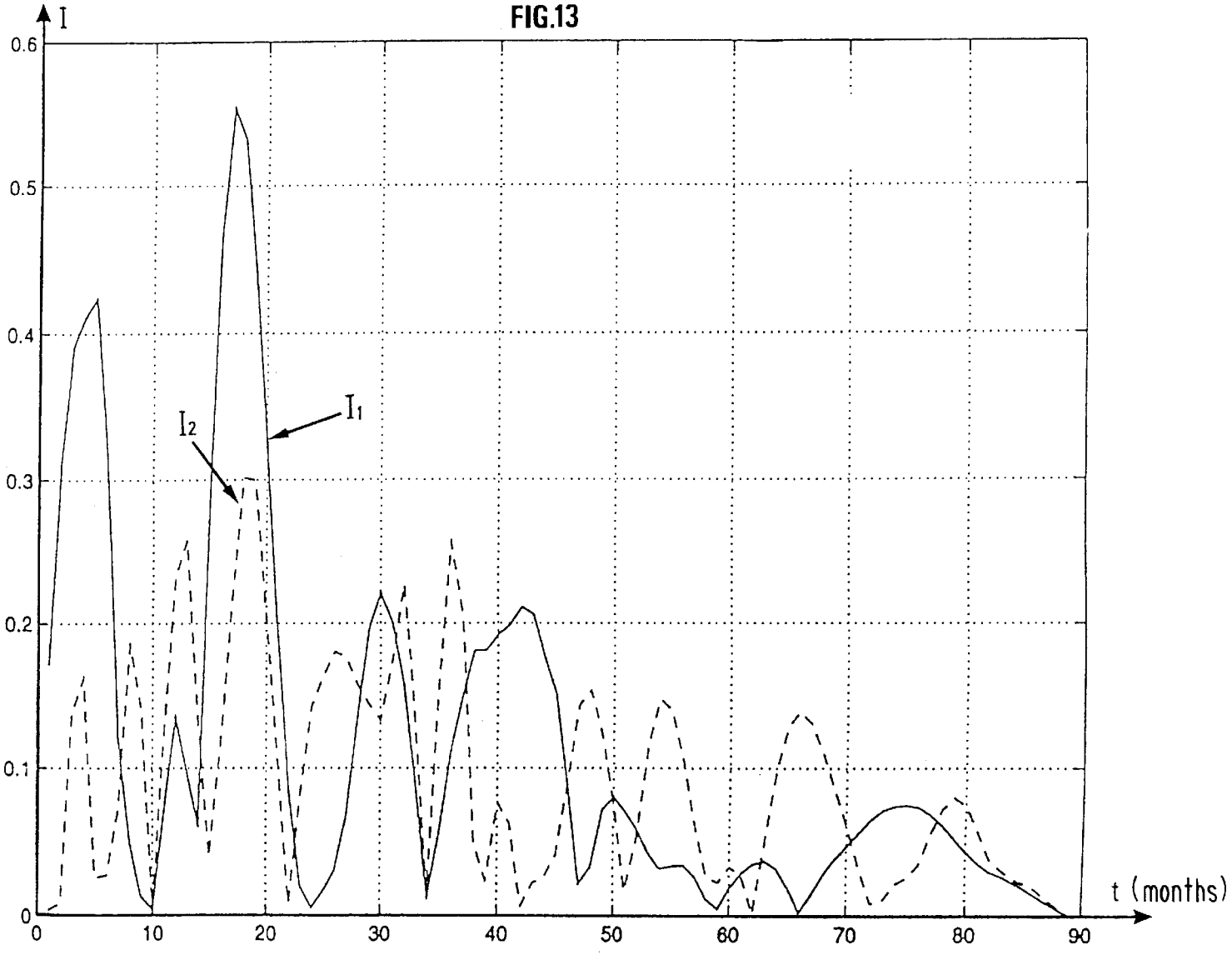
FIG. 13 shows examples I1, I2 of crosscorrelation functions between the watercut of well W1 (output data) and respectively of the monthly production rates of wells W8 and W12 (input data)

In order to select the most significant input data, a crosscorrelation between the output (averaged and filtered watercut of well W1) and each of the inputs is achieved. The 11 crosscorrelation functions thus obtained are arranged in ascending order of their maximum. FIG. 13 shows an example of comparison between two crosscorrelation functions. It shows that the flow rate of well W8 has a greater influence of the watercut of well W1 than the flow rate of well W12 that is remoter and can obviously not have a notable influence.

4) Optimal model obtained

The output is the averaged and filtered watercut of well W1: $fw_{(w1)}$. The inputs selected are the filtered flow rate values of the following wells:

qW8: production rate of well W8 ($m^3$/month)

qW11: production rate of well W11 ($m^3$/month)

qW4: injection rate of well W4 ($m^3$/month)

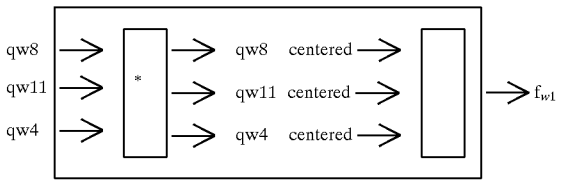

$$fw(W1)(t)=0.9132\ fw(W1)(t-1)-0.6465\ fw(W1)(t-2)$$
$$-0.0028\ q_{centered(W8)}(t-1)$$
$$+0.5546e-3\ q_{centered(W11)}(t-1)$$
$$-0.0020\ q_{centered(W4)}(t-2)+0.0011\ q_{centered(W4)}(t-3)$$
$$+69.6992$$

The "centering" performed consists in taking away the zero-sequence component of the signal that represents its average: x(centered)=x−average(x).

Figure 14:
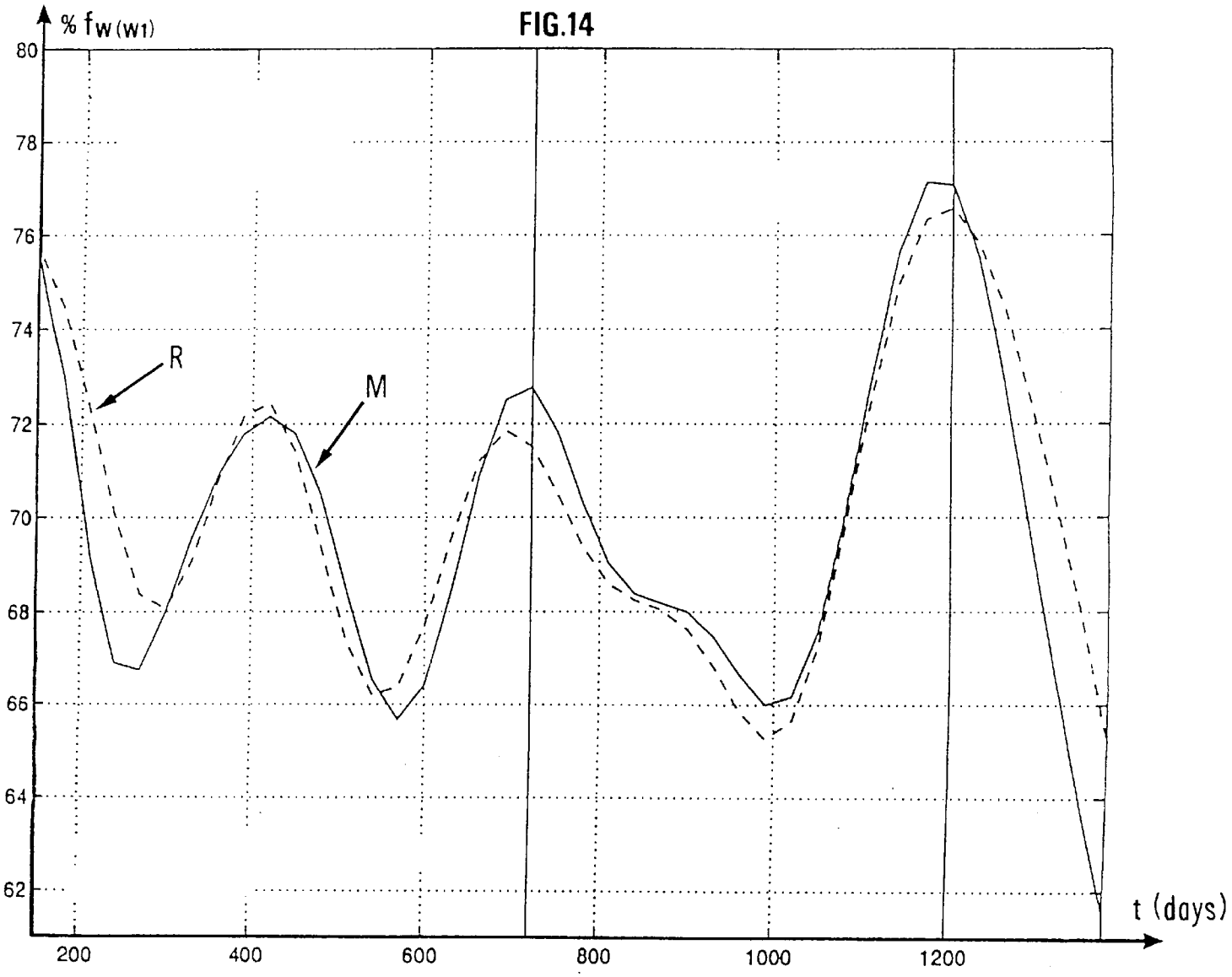
FIG. 14 shows a comparison of the results of model M obtained for well W1, with the real measurements R.

In FIG. 13, the output calculated with the model (full line) can be compared with the real output (dotted line). The model is satisfactory and reliable: a good extrapolation is obtained over more than 19 months preceding the identification period and over 6 months after this period, identification itself being achieved over a period of 16 days as represented by the spacing between the verticle lines along the time axis of FIG. 14.

Selection of the number of coefficients and of the delays is important. The lowest possible number of coefficients is required to obtain a robust optimum model. The delays can be selected according to the distance of the "input " wells from the "output" wells.

We claim:

1. A method for modelling, in a series of wells crossing a zone of an underground hydrocarbon reservoir under development, effects of interactions between several wells of the series of wells on a watercut on effluents produced by at least one producing well of the series of wells swept by a sweeping fluid under pressure injected in at least one injection well, comprising:

obtaining data by processing raw data variations taken from records relative to injection of the sweeping fluid in the reservoir and records relative to a production of the effluents by the at least one production well; and iteratively setting up an optimized linear model based upon variations over time of the obtained data relative to the watercut in the production of the at least one producing well with variations over time of the obtained data relative to other wells of the series of wells.

2. A method for modelling, in a series of wells crossing a zone of an underground hydrocarbon reservoir under development, effects of interactions between several wells of the series of wells on a watercut on effluents produced by at least one producing well of the series of wells swept by a sweeping fluid under pressure injected in at least one injection well and for controlling production of the reservoir, comprising:

obtaining data by processing raw data variations taken from records relative to injection of the sweeping fluid in the reservoir and records relative to a production of the effluents by the at least one production well;

iteratively setting up a linear models for modelling connections between variations with time of the obtained data relative to the watercut in the production of several producing wells in the series of wells with variations with time of the obtained data related to other wells of the series of wells; and performing an optimization of the linear model of the reservoir and utilizing the optimized linear model during production of the reservoir.

3. A method as claimed in claim 2, wherein the obtaining of the data includes frequency filtering of said raw data variations.

4. A method as claimed in claim 3, wherein the obtaining of the data includes a preliminary statistical processing of the raw data.

5. A method as claimed in claim 3, wherein the obtaining of the data includes resampling raw data variations with a regular spacing in time.

6. A method as claimed in claim 3, wherein the obtaining of the data includes resampling raw data variations with a regular spacing in time.

7. A method as claimed in claim 3, wherein the obtaining of the data includes resampling raw data variations with a regular spacing in time.

8. A method as claimed in claim 2, wherein the obtaining of the data includes frequency filtering raw data variations related to the watercut of the at least one producing well and frequency filtering of the raw data variations related to the other wells of the series of wells.

9. A method as claimed in claim 8, wherein the obtaining of the data includes low-pass filtering of the raw data variations to eliminate effects of noise and measuring errors.

10. A method as claimed in claim 8, wherein the obtaining of the data includes a preliminary statistical processing of the raw data.

11. A method as claimed in claim 2, wherein the obtaining of the data includes:

selecting, from the other wells of the series of wells, a limited number of wells exhibiting greatest interactions with the at least one producing well.

12. A method as claimed in the claim 11, wherein the obtaining of the data includes:

selecting the wells exhibiting greatest interactions by crosscorrelating two by two data associated with the watercut of the at least one producing well respectively with the data associated with the other wells of the series of wells.

13. A method as claimed in claim 11, wherein selection of the limited number of wells includes applying variations to the raw data variations of at least one injecting well and determining effects on the watercut in the production of the at least one production well.

14. A method as claimed in claim 2, wherein the obtaining of the data includes a preliminary statistical processing of the raw data.

* * * * *